US007635448B2

(12) United States Patent
Kuwabara et al.

(10) Patent No.: US 7,635,448 B2
(45) **Date of Patent: *Dec. 22, 2009**

(54) METHOD OF PRODUCING COMPOSITE MATERIAL

(75) Inventors: Mitsuo Kuwabara, Tsurugashima (JP); Masanori Ohtsuka, Shioya-gun (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/937,301

(22) Filed: Sep. 10, 2004

(65) Prior Publication Data

US 2005/0053510 A1 Mar. 10, 2005

Related U.S. Application Data

(63) Continuation of application No. 10/450,779, filed as application No. PCT/JP01/10888 on Dec. 12, 2001, now abandoned.

(30) Foreign Application Priority Data

Dec. 19, 2000 (JP) ..... 2000-385214

(51) Int. Cl.
*B22F 3/10* (2006.01)

(52) U.S. Cl. ..... 419/10; 419/13; 419/15; 419/16; 75/238; 75/242; 501/96.1

(58) Field of Classification Search ..... 419/13, 419/14, 10

See application file for complete search history.

(56) References Cited

U.S. PATENT DOCUMENTS

| | | | | | |
|---|---|---|---|---|---|
| 4,212,671 | A | * | 7/1980 | Ettmayer et al. | 75/238 |
| 4,265,662 | A | * | 5/1981 | Miyake et al. | 75/238 |
| 4,300,952 | A | * | 11/1981 | Ingelstrom et al. | 75/238 |
| 4,521,248 | A | * | 6/1985 | Yamamoto et al. | 75/238 |
| 4,639,352 | A | * | 1/1987 | Kodama et al. | 419/15 |
| 4,661,071 | A | * | 4/1987 | Bell et al. | 433/223 |
| 4,705,560 | A | * | 11/1987 | Kemp et al. | 75/342 |
| 4,769,070 | A | | 9/1988 | Tobioka et al. | |
| 4,863,538 | A | * | 9/1989 | Deckard | 264/497 |
| 4,891,341 | A | * | 1/1990 | Cutler et al. | 501/89 |
| 4,957,548 | A | | 9/1990 | Shima et al. | |
| 5,030,038 | A | | 7/1991 | Ariura | |
| 5,051,126 | A | | 9/1991 | Yasui et al. | |
| 5,147,831 | A | * | 9/1992 | Zeiringer | 501/96.1 |
| 5,155,321 | A | * | 10/1992 | Grube et al. | 264/497 |

(Continued)

FOREIGN PATENT DOCUMENTS

EP 0 635 580 A1 * 8/1994

(Continued)

*Primary Examiner*—George Wyszomierski
*Assistant Examiner*—Christopher Kessler
(74) *Attorney, Agent, or Firm*—Birch, Stewart, Kolasch & Birch, LLP

(57) ABSTRACT

A compact is obtained from a mixed powder of a multi-component system ceramics composed of constitutive elements of at least two metal elements selected from the group consisting of Ti, Al, V, Nb, Zr, Hf, Mo, Ta, Cr, and W, N, and optionally C; and Fe, Ni, Co, or an alloy composed of a constitutive element of at least one metal element of Fe, Ni, and Co. A composite material is prepared by sintering the compact.

6 Claims, 3 Drawing Sheets

U.S. PATENT DOCUMENTS

| | | | | | |
|---|---|---|---|---|---|
| 5,223,195 | A | * | 6/1993 | Kuwabara | 264/645 |
| 5,370,692 | A | * | 12/1994 | Fink et al. | 128/898 |
| 5,476,530 | A | | 12/1995 | Gries et al. | |
| 5,639,402 | A | * | 6/1997 | Barlow et al. | 264/6 |
| 5,756,410 | A | * | 5/1998 | Dunmead et al. | 501/96.1 |
| 6,322,728 | B1 | * | 11/2001 | Brodkin et al. | 264/19 |
| 6,808,659 | B2 | * | 10/2004 | Schulman et al. | 264/16 |
| 6,921,500 | B1 | * | 7/2005 | Feenstra | 264/19 |
| 2004/0035246 | A1 | * | 2/2004 | Kuwabara et al. | 75/241 |
| 2004/0186004 | A1 | * | 9/2004 | Kuwabara | 501/96.1 |

FOREIGN PATENT DOCUMENTS

| | | | | |
|---|---|---|---|---|
| EP | 0 635 580 | A | | 1/1995 |
| GB | 2100283 | A | * | 12/1982 |
| JP | 57-43982 | A | | 3/1982 |
| JP | 64-28340 | A | | 1/1989 |
| JP | 64-68443 | A | | 3/1989 |
| JP | 1-152228 | A | | 6/1989 |
| JP | 2-190438 | A | | 7/1990 |
| JP | 04-365840 | A | | 12/1992 |
| JP | 5-78777 | A | | 3/1993 |
| WO | WO 00/50657 | A | | 8/2000 |

* cited by examiner

METHOD OF PRODUCING COMPOSITE MATERIAL

This application is a Continuation of U.S. patent application Ser. No. 10/450,779 filed on Jun. 18, 2003, now abandoned, which claims priority under 35 U.S.C. § 120. U.S. application Ser. No. 10/450,779 is the national phase of PCT International Application No. PCT/JP01/10888 filed on Dec. 12, 2001, under 35 U.S.C. § 371, which designated the United States, and which claims priority to Japanese application no. 2000-385214 filed Dec. 19, 2000. The entire contents of each of the aboved-identified applications are hereby incorporated by reference.

TECHNICAL FIELD

The present invention relates to a composite material comprising a metal and a multi-component system ceramics composed of constitutive elements of two or more metal elements, N, and optionally C.

BACKGROUND ART

The composite material, which is produced by sintering metal particles and ceramic powder together, has the high toughness originating from the metal and the high hardness and the high strength originating from the ceramics. Such a composite material is widely used in a variety of fields. For example, the tungsten carbide-cobalt system cemented carbide obtained by sintering tungsten carbide and cobalt, and the titanium carbide system cermet obtained by sintering titanium carbide and molybdenum are adopted as the edge for the cutting tool. Such a composite material is further blended, for example, with niobium carbide in some cases.

The composite material usually has a sufficient hardness. However, the composite material is sometimes required to have a higher hardness depending on the use or application. Then, a composite material is sometimes produced to have a shape depending on the use or application such that the composite material contains diamond or ceramics having higher hardness such as tetragonal system boron nitride (c-BN).

However, the composite material containing diamond or c-BN is not excellent in oxidation resistance. Further, the composite material containing diamond or c-BN is expensive. Therefore, in many cases, the surface of the composite material is coated with a thin film composed of a high hardness substance such as TiC and TiN, by means of the physical vapor deposition (PVD) method or the chemical vapor deposition (CVD) method.

However, when the thin film is formed by means of the PVD method or the CVD method, it is impossible to efficiently form the thin film, because the reaction efficiency is low and the reaction velocity is slow. For this reason, the production cost of the composite material becomes expensive. Further, the size and the shape of a workpiece are restricted, because the reaction chamber of the PVD apparatus or the CVD apparatus has a predetermined volume. Furthermore, the thin film is readily peeled off under a high stress.

As described above, if it is intended to realize a high hardness of the composite material, then the composite material is chemically unstable, and the production cost is expensive.

DISCLOSURE OF INVENTION

The present invention has been made in order to solve the problems as described above, an object of which is to provide a composite material which has a high strength and a high hardness as compared with a composite material containing a two-component system ceramics.

In order to achieve the above object, a composite material of the present invention contains a multi-component system ceramics composed of constitutive elements of N and at least two metal elements selected from the group consisting of Ti, Al, V, Nb, Zr, Hf, Mo, Ta, Cr, and W; and a metal selected from the group consisting of Fe, Ni, Co, and an alloy composed of a constitutive element of at least one metal element of Fe, Ni, and Co. That is, the composite material according to the present invention contains a composite nitride ceramics composed of three or more components, which is represented, for example, by Ti—Al—N and Ti—Al—V—Nb—Zr—N.

The composite material, which contains the above multi-component system ceramics, exhibits a high hardness as compared with a sintered product containing a two-component system ceramics such as TiN, TiC, and NbC. The relative density of the composite material according to the present invention is close to the ideal density. Therefore, the composite material also exhibits a high strength and a high toughness.

Further, C may be contained as a constitutive element. That is, the multi-component system ceramics, which is contained in the composite material according to the present invention, may be a composite carbonitride ceramics represented, for example, by Ti—Al—Nb—(C, N). In this case, a higher hardness is preferably exhibited as compared with the composite material containing the composite nitride ceramics.

A preferable atomic ratio between C and N satisfies $C/N<1$. If C/N is not less than 1, the hardness of the composite material is lowered in some cases depending on the type of the multi-component system ceramic powder.

In any type of the composite material, it is preferable that a ratio of the multi-component system ceramics is 60 to 97% by weight, and a ratio of the metal is 40 to 3% by weight. If the ratio of the multi-component system ceramics is less than 60% by weight, an obtained composite material is poor in abrasion resistance and strength. If the ratio of the multi-component system ceramics exceeds 97% by weight, then the strength and the toughness of an obtained composite material are lowered, and the stress intensity factor is increased.

The above and other objects, features, and advantages of the present invention will become more apparent from the following description when taken in conjunction with the accompanying drawings in which a preferred embodiment of the present invention is shown by way of illustrative example.

BEST MODE FOR CARRYING OUT THE INVENTION

Figure 1:
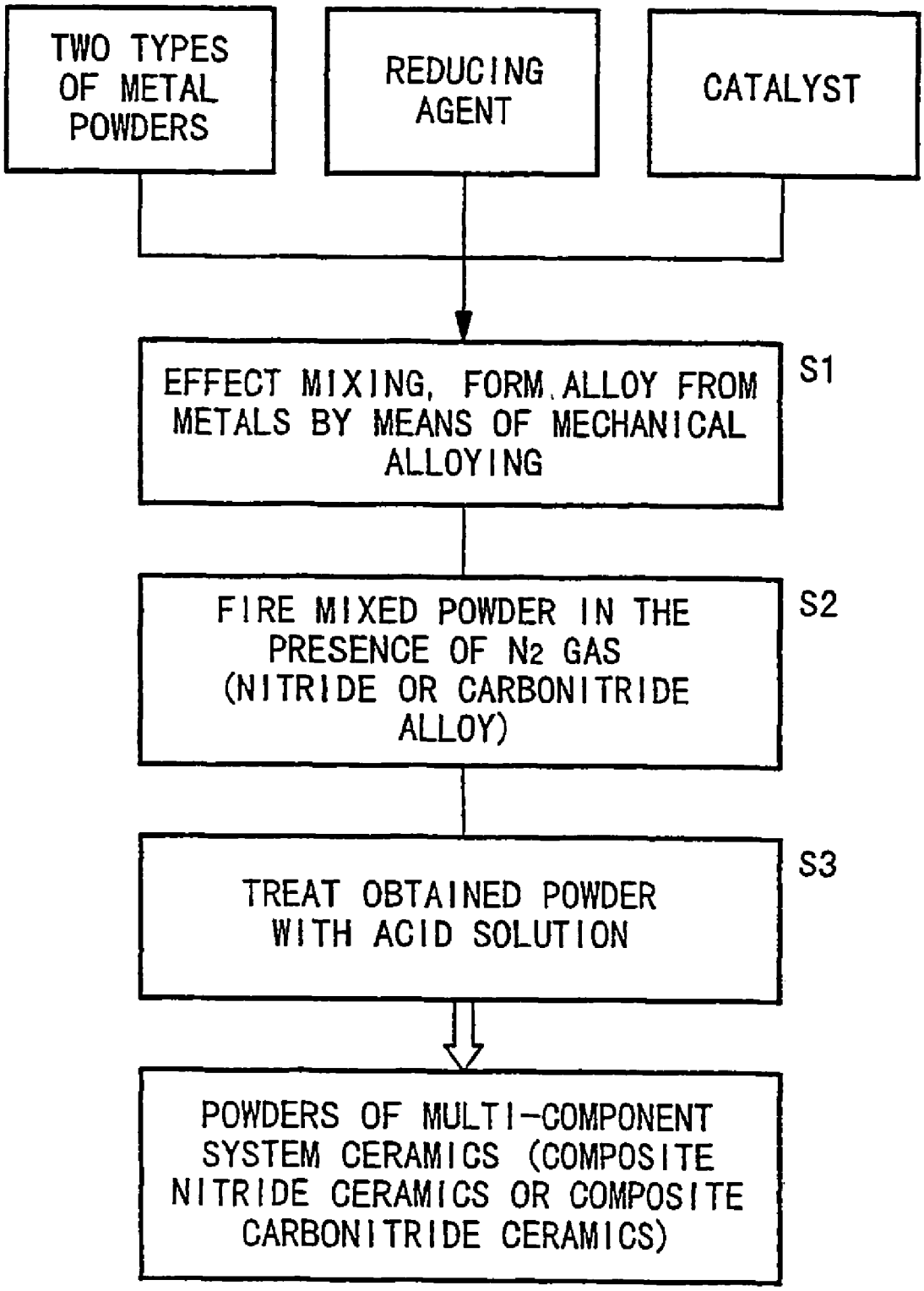
FIG. 1 is a flow chart illustrating a process for producing a multi-component system ceramic powder as a raw material for a composite material according to an embodiment of the present invention.

The composite material of the present invention will be exemplified by preferred embodiments, which will be explained in detail below with reference to the accompanying drawings.

A composite material according to an embodiment of the present invention contains a multi-component system ceramics and a metal.

The multi-component system ceramics in the embodiment of the present invention is a composite nitride ceramics composed of constitutive elements of N and two or more metal elements, or a composite carbonitride ceramics composed of constitutive elements of N, C, and two or more metal elements.

The metal elements for constructing the multi-component system ceramics are two or more elements selected from the group consisting of Ti, Al, V, Nb, Zr, Hf, Mo, Ta, Cr, and W. They constitute an alloy capable of being nitrided or carbonitrided together.

N is supplied from a source of nitrogen gas contained in an atmospheric gas to be used when the alloy, which is composed of the constitutive elements of two or more of the metal elements described above, is subjected to a sintering treatment. The composite nitride ceramics is obtained by nitriding, with nitrogen gas, the alloy composed of the constitutive elements of two or more of the metal elements described above.

In the composite carbonitride ceramics which further contains C as the constitutive element, C is supplied from a source of a powder carbon material such as carbon black. The composite material, which contains the composite carbonitride ceramic component, exhibits a higher hardness as compared with the composite material containing the composite nitride ceramic component.

When C is contained as the constitutive element, the preferable atomic ratio between C and N satisfies $C/N<1$. If C/N is not less than 1, the hardness of the composite material is lowered in some cases depending on the type of the multi-component system ceramic powder. More preferably, the atomic ratio satisfies $0.4<C/N<0.9$.

Fe, Ni, Co, or an alloy containing a constitutive element of at least one metal element of them is selected as the metal for constructing the composite material. In the alloy, the constitutive element other than the above includes, for example, Cr, Mo, V, Mn, Ti, Al, W, Si, and Ta. For example, Fe—Mo alloy may be used as the metal in place of Fe. Both of Fe and Fe—Mo alloy may be used as the metal.

Such a metal has a high melting point and a high toughness. Therefore, the composite material, which contains such a metal, exhibits heat resistance and high toughness.

It is preferable for the composite material that the ratio of the multi-component system ceramics is 60 to 97% by weight, and the ratio of the metal is 40 to 3% by weight. If the ratio of the multi-component system ceramics is less than 60% by weight, and the ratio of the metal exceeds 40% by weight, then the composite material is poor in abrasion resistance and strength. On the other hand, if the ratio of the multi-component system ceramics exceeds 97% by weight, and the ratio of the metal is less than 3% by weight, then the strength and the toughness of the composite material are lowered, and the stress intensity factor is increased, for the following reason. That is, the densification process for the multi-component system ceramic powder is scarcely advanced when the sintering is performed. As a result, an obtained composite material has a low relative density.

The composite material can be produced as follows.

A powder of the multi-component system ceramics is firstly produced by the steps of a flow chart shown in FIG. 1.

In the mechanical alloying step Si, metal particles, a reducing agent, and a catalyst are mixed with each other. As for the metal particles, at least two types of powders are selected from the group consisting of Ti, Al, V, Nb, Zr, Hf, Mo, Ta, Cr, and W. They readily form an alloy by means of the mechanical alloying.

The reducing agent is used to reduce any oxide film formed on the surface of the metal. Usually, such a metal is coated with an oxide film which is formed as a result of oxidation of the surface with oxygen in the air. The reducing agent reduces the oxide film, while the reducing agent itself is oxidized during the sintering treatment.

Preferred examples of the reducing agent which thus function include powder carbon materials and alkaline earth metals represented by Mg, Ca, Sr, and Ba. All of them have a strong reducing power as compared with the above metal. Therefore, they serve as an effective reducing agent for the above metal.

Among them, the powder carbon material is preferably used. The powder carbon material is easy to be handled, and it is inexpensive and advantageous from a viewpoint of cost. CO or $CO_2$ is produced when the powder carbon material is reacted with the oxide film. CO or $CO_2$ is gas which can be discharged readily and quickly outside a sintering furnace when the sintering treatment step S2 is performed. In other words, no oxide remains. Therefore, a high purity multi-component system ceramic powder can be obtained. Further, the powder carbon material also acts as a C source. Therefore, it is possible to produce the composite carbonitride ceramics having a high hardness as compared with the composite nitride ceramics.

The preferable added ratio of the powder carbon material is 0.1 % by weight to 11.6% by weight. If the ratio is less than 0.1% by weight, the ability as the reducing agent is poor. On the other hand, if the ratio exceeds 11.6 t by weight, free carbon is produced. When Al powder is selected as the metal, $Al_4C_3$ is also produced. A sintered product containing such a component is inferior in hardness and toughness.

When Mg powder is used as the reducing agent, the Mg powder may be added in an amount of 0.1 to 5 g with respect to 100 g of the metal powder. When Ba powder is used, the Ba powder may be added in an amount of 0.5 to 10 g with respect to 100 g of the metal powder.

The catalyst facilitates the nitriding process for the metal. When the powder carbon material is present, the catalyst also facilitates the carbonitriding process.

Preferred examples of the catalyst may include alkaline earth metals, elements of the VIIA group, and elements of the VIII group. Among them, it is preferable to use the elements of the VIIA group or the elements of the VIII group. Such an element is readily eluted into an acid solution by the acid treatment step S3 as described later on. Accordingly, the multi-component system ceramics can be obtained at a high purity. The VIII group element is exemplified by Fe, Co, and Ni. The VIIA group element is exemplified by Mn. Mn is preferably used among them because Mn is most excellent in function to facilitate the nitriding process or the carbonitriding process described above.

The preferable added ratio of the catalyst is not definitely determined because the ratio differs depending on the type of the catalyst. For example, when Mn is used, the ratio is preferably not more than 3% by weight. When Fe, Co, or Ni is used, the ratio is preferably not more than 5% by weight. If the catalyst is added in a ratio over the above ratio, the remaining amount of unreacted catalyst is increased, or the produced amount of nitride or carbonitride is increased in any case. Therefore, it is not easy to improve the hardness of the sintered product, because it is not easy to elute them in the acid treatment step S3.

Not only the pure substances of the alkaline earth metal, the element of the VIIA group, and the element of the VIII group but also compounds can be used for the reducing agent and the catalyst. For example, a powder of carbonyliron or carbonickel may be used in place of the powder of Fe or Ni. Such a compound powder has a grain size which is extremely small as compared with the pure substance powder, and hence the compound powder is dispersed homogeneously in the mixed powder. Accordingly, it is possible to facilitate the nitriding process or the carbonitriding process with a small amount of addition as compared with the pure substance powder. Therefore, it is possible to save resources and to reduce the cost.

The metal particles, the reducing agent, and the catalyst as described above are mixed under a condition in which the selected two types of metals form the alloy together by the mechanical alloying. Specifically, the metal particles, the reducing agent, the catalyst, and steel balls are accommodated in a water-cooled vessel which constitutes an attriter. The water-cooled vessel is sealed, and rotary vanes inserted into the water-cooled vessel are operated and rotated. Accordingly, the metal particles are ground and contacted under a pressure with high energy. As a result, the alloy powder is produced. Further, the reducing agent and the catalyst are dispersed substantially homogeneously in the alloy powder.

The alloy powder thus obtained is subsequently subjected to the sintering treatment in the presence of nitrogen gas in the sintering treatment step S2. Then, the nitriding process for the alloy is advanced in the mixed powder which contains no powder carbon material. On the other hand, the carbonitriding process is advanced in the mixed powder which contains the powder carbon material.

The nitrogen gas is contained in the atmospheric gas in such a degree that the alloy may be nitrided or carbonitrided. Only the nitrogen gas may be used as the atmospheric gas. Alternatively, a mixed gas, which contains the nitrogen gas and another inert gas such as argon gas, may be used as the atmospheric gas.

The preferable temperature for the sintering treatment is 1000° C. to 1600° C. If the temperature is less than 100° C., the nitriding or carbonitriding process is not advanced efficiently. On the other hand, even when the temperature exceeds 1600° C., the advancing velocity of the nitriding process or the carbonitriding process is not improved. As a result, the production cost for the multi-component system ceramics is expensive.

In the sintering treatment step S2, the oxide film, which is formed on the surface of the alloy, is firstly reduced. That is, the surface of the alloy is coated with the oxide film which is formed such that the metal for constructing the alloy is oxidized by oxygen in the air. The oxide film is reduced by the reducing agent, and the alloy becomes active.

When the powder carbon material is used as the reducing agent, then the powder carbon material deprives oxygen of the oxide film, and thus the powder carbon material itself is oxidized and converted into CO or $CO_2$. Both of them are gaseous, and hence they can be discharged readily and quickly outside the sintering furnace together with the atmospheric gas.

When the oxide film is reduced, the surface of the alloy is in an extremely active state. Accordingly, the alloy is readily nitrided from the surface to the inside. When the powder carbon material is used as the reducing agent, the excessive powder carbon material also acts as a C source. In this case, the alloy is carbonitrided from the surface to the inside.

During the sintering treatment step S2, the catalyst is also oxidized in some cases. When the alkaline earth metal is used as the reducing agent, then the alkaline earth metal deprives oxygen of the oxide, the alkaline earth metal itself is oxidized, and the alkaline earth metal remains as an oxide in the multi-component system ceramic powder. The unreacted reducing agent, the catalyst, the oxide of the reducing agent, and the oxide of the catalyst are present as impurities in a mixed manner in the multi-component system ceramic powder obtained by the sintering treatment step S2. When the sintered product is produced by using the raw material of the multi-component system ceramic powder containing the impurities in the mixed manner, the hardness of the sintered product is low in some cases.

Accordingly, in the next acid treatment step S3, the impurities are separated and removed from the multi-component system ceramic powder. Specifically, the impurities are eluted by immersing the obtained multi-component system ceramic powder in an acid solution.

The acid solution preferably contains hydrofluoric acid or hydroborofluoric acid. These acids can excellently dissolve the above impurities, thereby making it possible to efficiently separate and remove the impurities from the multi-component system ceramic powder.

The multi-component system ceramic powder having a high purity is obtained by performing filtration to separate the filtrate and the powder, and then neutralizing and treating the powder followed by washing with water.

Subsequently, a mixed powder of the multi-component system ceramic powder thus obtained and metal particles is prepared. Powder of Fe, Ni, Co, or the alloy as described above is selected for the metal particles. In this process, the preferable weight ratio between the multi-component system ceramic powder and the metal particles satisfies (multi-component system ceramic powder): (metal particles)=60:40 to 97:3.

Finally, a compacting load is applied to the mixed powder to prepare a compact. Next, the compact is sintered and the multi-component system ceramic powder is subjected to grain growth. Accordingly, the composite material is obtained as a product. The sintering temperature is preferably 1350° C. to 1550° C., and the sintering time is preferably not less than 15 minutes, depending on the type of the multi-component system ceramic powder to be used.

The composite material, which is obtained from the raw materials of the metal particles and the multi-component system ceramic powder, is excellent in hardness, toughness, and strength as compared with the composite material which is obtained from the raw materials of the metal particles and the two-component system ceramics such as TiN, TiC, WC, and MoC, for the following reason. That is, the multi-component system ceramics itself is more excellent in hardness, toughness, and strength than the two-component system ceramics.

In other words, when the multi-component system ceramics is adopted in place of the two-component system ceramics which has been hitherto adopted as the raw material for the composite material, it is possible to constitute the composite material which is more excellent in strength, toughness, and hardness than the conventional composite material.

The atmosphere, which is used when the sintering is performed, is preferably nitrogen. In this case, the multi-component system ceramic powder in the compact is further nitrided. As a result, the multi-component system ceramic powder is rounded. The composite material, which contains the rounded multi-component system ceramics, is much more excellent in strength and toughness.

The composite material can be used, for example, for molds or edge tools for cutting machining such as tips and bits. That is, when the mixed powder of the multi-component system ceramic powder and the metal particles is compacted into a predetermined shape followed by sintering, it is possible to obtain, for example, molds and edge tools for cutting machining having high strength, high toughness, and high hardness.

The compact may be preliminarily sintered to form a porous sintered product, and then a coating film, which is composed of a grain growth-facilitating agent for facilitating the grain growth of the multi-component system ceramic powder, may be formed on the surface of the porous sintered product. Preferred examples of constitutive materials for the coating film may include boron compounds. Especially, a coating film, which is composed of h-BN (hexagonal system boron nitride), is preferred, because it can be formed readily at low cost.

The coating film can be formed, for example, by spraying, onto the surface of the porous sintered product, a solution obtained by dispersing the grain growth-facilitating agent such as h-BN in a solvent such as xylene, toluene, and acetone, and then volatilizing and removing the solvent. Alternatively, the coating film may be formed by the chemical vapor deposition (CVD) method or the physical vapor deposition (PVD) method.

During the sintering process, the grain growth of the multi-component system ceramic powder is facilitated by the coating film (grain growth-facilitating agent). Therefore, the relative density is further increased. Accordingly, the obtained composite material exhibits the high strength and the high toughness.

EXAMPLES

W—Ti—Nb—N—C system ceramic powder, W—Ti—Nb—Al—N—C system ceramic powder, W—Ti—Zr—Nb—Ta—Al—N—C system ceramic powder, or W—Ti—Zr—Hf—Nb—V—N—C system ceramic powder and Co powder were mixed at a variety of weight ratios. The multi-component system ceramic powder had an average grain size of 2.5 μm, and the Co powder had an average grain size of 1.4 μm.

Each of the mixed powders was compacted into a rectangular parallelepiped of 70 mm×20 mm×20 mm at a pressure of 150 MPa. Only the compact, which contained W—Ti—Nb—N—C system ceramic powder, was preliminarily sintered at 927° C. for 15 minutes, and then a xylene solution dispersed with h-BN was spray-applied to the surface of the preliminarily sintered product. Further, the preliminarily sintered product was sintered by performing a sintering treatment in a nitrogen atmosphere at 1400 to 1500° C. for 60 minutes to obtain a composite material. On the other hand, each of the other compacts was sintered by performing a sintering treatment in a nitrogen atmosphere at 1400 to 1500° C. for 60 minutes to obtain a composite material without performing the preliminary sintering and the application of the xylene solution dispersed with h-BN. The obtained composite materials were designated as Examples 1 to 4 respectively.

For the purpose of comparison, a composite material was obtained in the same manner as in the method performed for Examples 2 to 4 except that WC powder having an average grain size of 2.5 μm and Co powder having an average grain size of 1.4 μm were mixed to perform a sintering treatment in a mixed atmosphere of argon and carbon monoxide. The obtained composite material was designated as Comparative Example.

Figure 2:
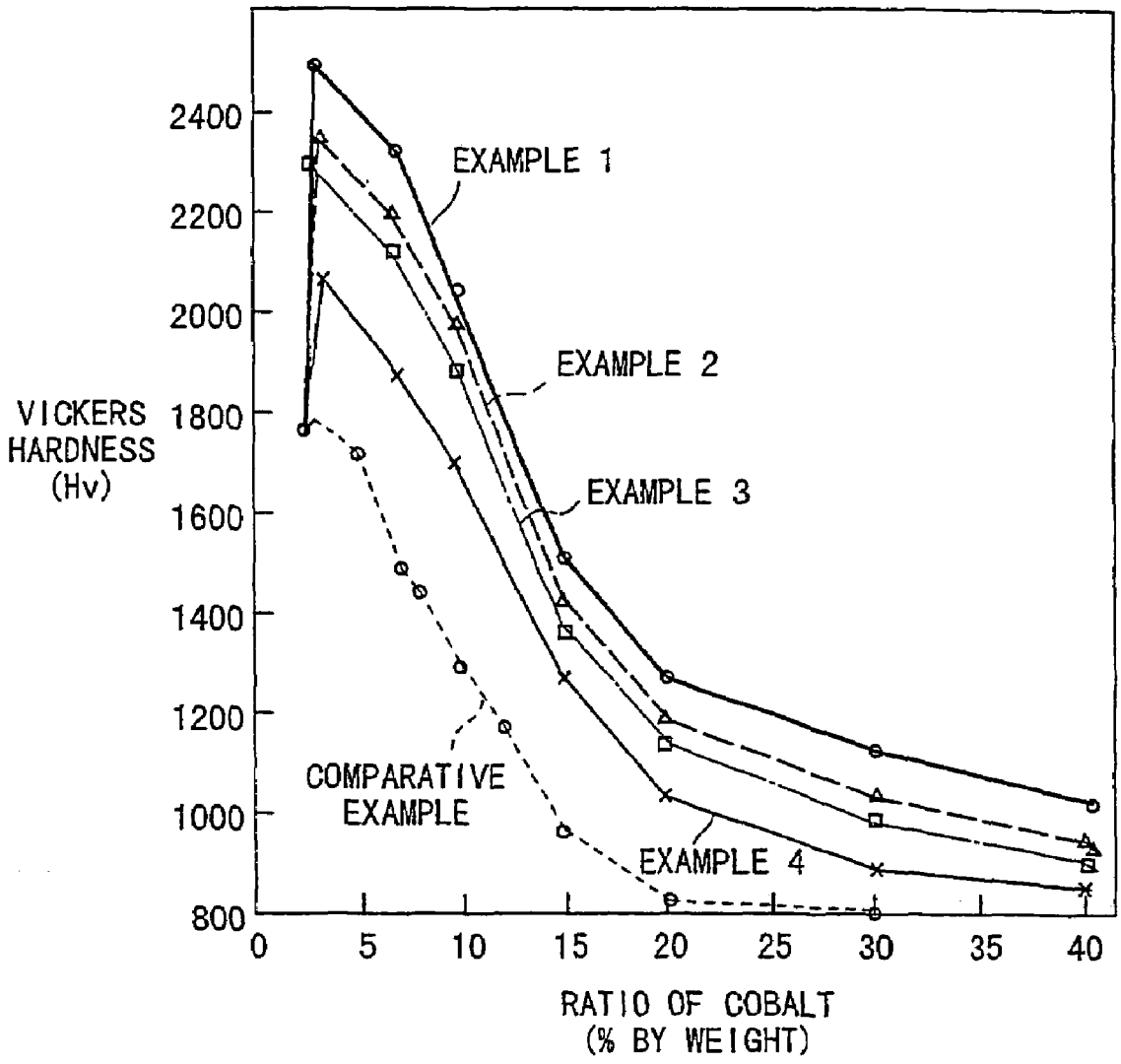
FIG. 2 is a graph illustrating the change of the Vickers hardness depending on the ratio of Co in respective composite materials prepared in Examples 1 to 4 and Comparative Example.

Subsequently, each of the composite materials of Examples 1 to 4 and Comparative Example was centrally cut, and an obtained cross section was mirror-polished. The Vickers hardness (Hv) of the cross section was measured. The relationship between the ratio of cobalt and Hv is shown in FIG. 2. According to FIG. 2, the composite materials of Examples 1 to 4 clearly have the high hardness as compared with the composite material of Comparative Example, regardless of the ratio of cobalt.

Figure 3:
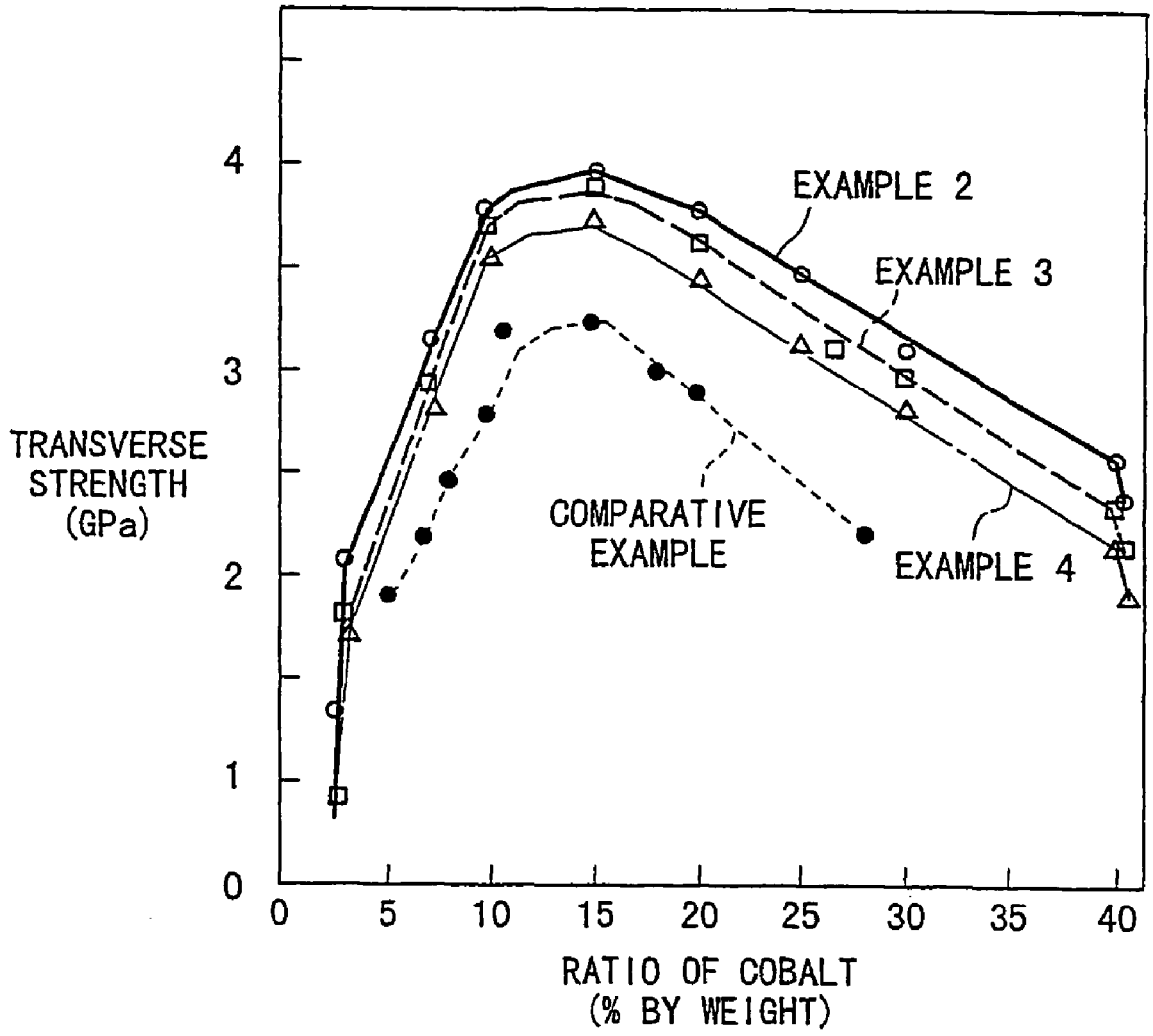
FIG. 3 is a graph illustrating the change of the Vickers hardness depending on the ratio of Co in respective composite materials prepared in Examples 2 to 4 and Comparative Example.

A transverse strength test piece was cut from each of the composite materials of Examples 2 to 4 and Comparative Example by the JIS-standard to measure the transverse strength. The relationship between the ratio of cobalt and the transverse strength is shown in FIG. 3. According to FIG. 3, the composite materials of Examples 2 to 4 clearly have the high transverse strength as compared with the composite material of Comparative Example over the all range of the ratio of cobalt.

That is, the composite materials of Examples 1 to 4 are more excellent in both strength and hardness than the composite material of Comparative Example. The toughness of each of the composite materials of Examples 1 to 4 is not lower than the toughness of the composite material of Comparative Example, because the ratio of cobalt is identical. In other words, the composite material according to the embodiment of the present invention has the toughness equivalent to the toughness of the conventional composite material, and it is more excellent in hardness and strength.

According to FIGS. 2 and 3, it is clearly understood that Hv and the transverse strength are extremely different between the case in which the ratio of cobalt is 2.5 % by weight and the case in which the ratio of cobalt is 3% by weight. That is, the relative density was about 95% when the ratio of cobalt was 2.5% by weight, and the relative density was substantially 100% when the ratio of cobalt was 3% by weight. Therefore, the densification is not sufficiently achieved if the ratio of cobalt is 2.5% by weight.

As explained above, the composite material according to the present invention contains the multi-component system ceramics which is composed of the constitutive elements of the two or more metals, N, and optionally C. Therefore, the composite material according to the present invention has the high strength and the high hardness as compared with the conventional composite material which contains the two-component system ceramics such as TiC and WC.

The composite material can be used, for example, as the mold or the edge tool for cutting machining such as the tip and the bit.

While the invention has been particularly shown and described with reference to preferred embodiments, it will be understood that variations and modifications can be effected thereto by those skilled in the art without departing from the spirit and scope of the invention as defined by the appended claims.

What is claimed is:

1. A method of producing composite material including:

a multi-component system ceramics comprised of constitutive elements of N, C and at least two metal elements selected from the group consisting of Ti, Al, V, Nb, Zr, Hf, Mo, Ta, Cr, and W; and a metal selected from the group consisting of Fe, Ni, Co, and an alloy composed of a constitutive element of at least one metal element of Fe, Ni, and Co;

wherein said method comprises the steps of:

mixing metal particles which are comprised of at least two types of powders selected from the group consisting of Ti, Al, V, Nb, Zr, Hf, Mo, Ta, Cr, and W, and a reducing agent for reducing any oxide film formed on the surface of said metal particles, and a catalyst to form a mix powder, and forming an alloy by mechanical alloying said metal particles in said mix powder;

sintering said mix powder in the presence of nitrogen gas to obtain multi-component system ceramics powder;

removing impurities from said multi-component system ceramic powder by using an acid solution;

mixing said multi-component system ceramic powder and a metal powder selected from the group consisting of Fe, Ni, Co, and an alloy composed of a constitutive element of at least one metal element of Fe, Ni, and Co, and performing heat treatment, wherein the catalyst is selected from a group consisting of elements of Group VIIA other than Manganese (Mn) and Rhenium (Re), and compounds of Group VIIA other than Manganese (Mn) and Rhenium (Re).

2. The method according to claim 1, wherein a ratio of said multi-component system ceramics is 60 to 97% by weight, and a ratio of said metal is 40 to 3% by weight.

3. The method according to claim 1, wherein alkaline earth metals, alkaline earth metal compounds, or carbon are used as said reducing agent.

4. The method according to claim 1, further comprising the step of mixing the metal particles, the reducing agent and the catalyst in a water-cooled vessel which constitutes an attriter.

5. The method according to claim 1, further comprising the step dispersing the reducing agent and the catalyst substantially homogeneously in the alloy.

6. The method according to claim 1, wherein the sintering step oxidizes the catalyst, and the removing step separates and removes oxides of the catalyst from the multi-component system ceramics powder.

* * * * *